United States Patent [19]

Adams et al.

[11] 4,047,513

[45] Sept. 13, 1977

[54] IGNITION SYSTEM WITH GAS DISCHARGE TUBE CIRCUIT

[75] Inventors: Guy Emery Adams, Monroe, N.Y.; Anna J. Pellegrin, Closter, N.J.

[73] Assignee: Solitron Devices, Inc., Tappan, N.Y.

[21] Appl. No.: 632,497

[22] Filed: Nov. 17, 1975

[51] Int. Cl.[2] ..... F02P 1/00

[52] U.S. Cl. ..... 123/148 E

[58] Field of Search ..... 123/148 E, 148 S; 315/209 T

[56] References Cited

U.S. PATENT DOCUMENTS

| | | | |
|---|---|---|---|
| 3,016,476 | 5/1977 | Bataille | 123/148 E |
| 3,831,570 | 8/1974 | Compton et al. | 123/148 E |
| 3,871,347 | 3/1975 | Weber | 123/148 E |
| 3,933,141 | 1/1976 | Gunderson | 123/148 E |

*Primary Examiner*—Carlton R. Croyle
*Assistant Examiner*—L. J. Casaregola
*Attorney, Agent, or Firm*—Richard G. Geib

[57] ABSTRACT

A circuit for use in an ignition system for an internal combustion engine which includes an electronic switch for control of the charging and discharging of an ignition coil with a capacitive controlled gas discharge tube circuit to provide protection for the electronic switch and permit increased dwell time for the coil.

6 Claims, 1 Drawing Figure

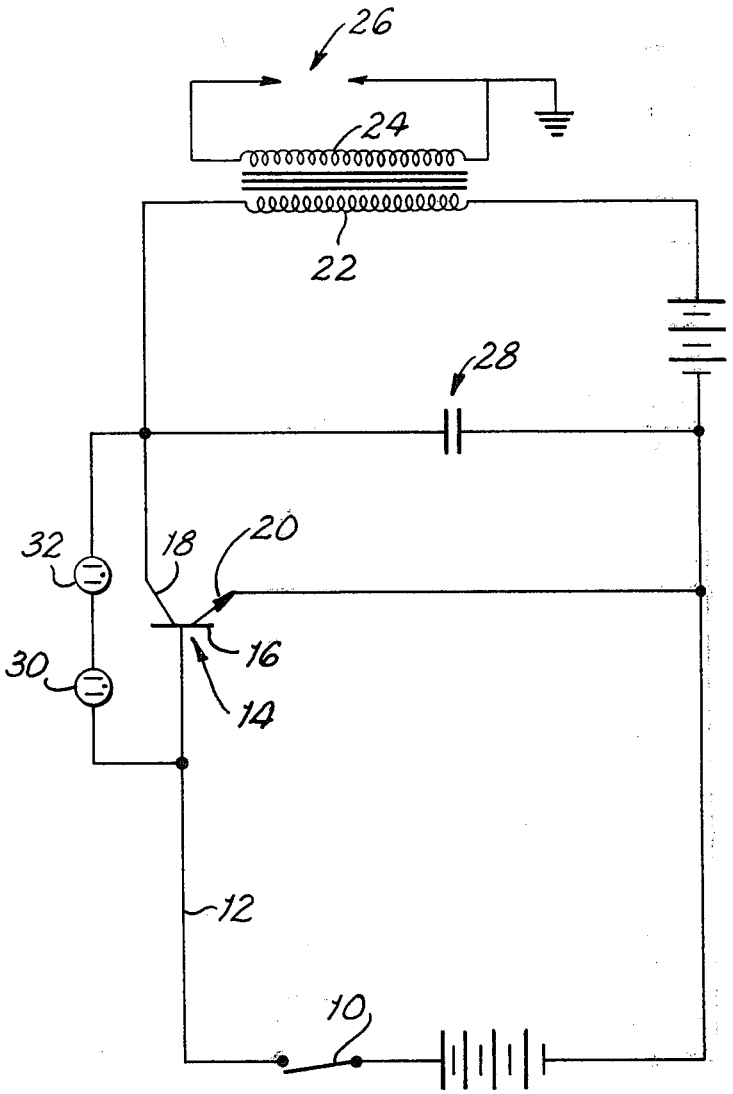
26
24
22
28
32
18
20
16
30
14
12
10

IGNITION SYSTEM WITH GAS DISCHARGE TUBE CIRCUIT

BACKGROUND

For some three years running, electronic ignition systems have worked successfully in automotive applications. In almost all of the known systems it has been the desire of those skilled in the art to use zener diodes to protect the semiconductor circuit controlling the charging and discharging of an ignition coil from reverse current that would fail the semiconductor switching means.

It has been equally well known by those skilled in the art to use with a semiconductor ignition circuit a capacitor to protect against the transient generation of excessive E.M.F. induced by the collapse of a magnet field in a primary winding of an ignition coil.

Also, it has been proposed by those skilled in the art to limit or regulate the voltage across an ignition coil by means of gas discharge lamps to eliminate transient voltage peaks.

It is now the principle object of this invention to disclose to the art a circuit using two gas discharge tubes in series controlled by a capacitor so as to protect solid state devices and more importantly make it possible at the same time to increase energy available in a primary winding of an ignition coil.

These and other objects are obtained by a circuit comprising a transistor switch responsive to timing switch means, be it a set of breaker points or induction pick-ups as are now becoming more common, which are connected to a primary winding such that a parallel circuit of a capacitor and a series circuit of gas discharge tubes are interposed about different portions of the transistor to protect it and allow greater coil energy.

The various features and advantages of the present invention will become more apparent upon a consideration of the following description taken in conjunction with the accomanying drawings.

DRAWING DESCRIPTION

The drawing is a schemtic circuit diagram of an internal combustion engine electronic ignition system which uses a protective circuit in accordance with this invention.

DETAILED DESCRIPTION

With particular reference to the drawing there is shown an automotive engine ignition wiring circuit in schematic form for the electronic systems not known in the art. Specifically, this circuit is comprised of switch means 10 as may be utilized in a conventional distributor of an internal combustion engine. This may be a set of a breaker points or an induction means utilizing the breaker cam and a permanent magnet to provide a signal via a circuit represented by leads 12 to a switching tansistor 14. This signal being impressed on base 16 will permit conduction across the collector 18 and emitter 20 of transistor 14 or the opening of such elements as will and is readily understood to those skilled in the art. This will, respectively, charge a primary coil 22 or induce a voltage in secondary coil 24. The voltage induced in the secondary coil then generates a spark at the spark plug 26 to ignite a fuel-air mixture in the engine's cylinders at a timed sequence also readily familiar to those skilled in the art.

As will be readily apparent to those skilled in the art the very act of inducing high joules in the secondary coil 24 will cause resonating of the primary. This has proven in the past to provide a reverse current that could breakdown the transistor 14 either to an open or shorted condition.

In order to prevent such damage it is provided by this invention that a capacitor 28 be connected across the collector-emitter portions of transistor 14 and that a series connection of gas discharge tubes 30 and 32 to be connected across the base-collector portions of transistor 14.

OPERATION

In operation as the secondary is being charged by a collapse of the primary field decay current flow towards transistor 14 is intercepted by capacitor 28 whereby the rise time of this reverse current is slowed. This then allows the gas discharge tubes 30 and 32 in a series circuit to fire simultaneously to shunt reverse current with capacitor 28 around transistor 14. As may be readily appreciated by those skilled in the art dwell or current build up time should be as extended as possible to enable coil energy to be maximized at all engine speeds. By using capacitor 28 to control buildup time for ionizing tubes 32 and 30 it is possible with this circuit about transistor 14 to with less time than known possible depending on mechanical or inductive switch 10 turn on the transistor to begin recharging the primary. This is a case of letting the devices that protect a circuit increase also the gain of same to permit the dwell or current buildup time to be increased or extended. This will enable the primary coil 22 to build and discharge a higher voltage at high operating speed. It should be noted that there will be increased energy available from the primary coil 22 in that the use of a series circuit of gas discharge tubes will permit one to approach a higher level of energy in that upon firing the voltage will drop quickly upon ionization. In other schemes one had to anticipate a rise so that the protective circuit fired early. When tubes 30 and 32 are on they become fully ionized and current is dropped to a rated value until extinction. It is to be understood that modifications and variations of the embodiments of the invention disclosed herein may be resorted to without departing from the spirit of the invention and scope of the appended claims.

Having thus described our invention what we claim as new and desired to protect by Letters Patent is:

1. A charging circuit for use in an electronic ignition circuit having an ignition coil controlled by a transistor, said circuit comprising:

a capacitor connected across the primary coil of the ignition coil and the collector and emitter of a switching transistor therefor; and gas discharge tubes in a series circuit in parallel with said capacitor between a source of electrical energy and said primary coil, said tubes being between the collector and base of said transistor.

2. The protective circuit of claim 1 wherein said series circuit of said gas discharge tubes is across the base and collector portions of said transistor between the coil and a battery.

3. An electronic ignition circuit comprising:

a source of timed signals:

semiconductor means responsive to said singals;

battery means controlled by said semiconductor means;

ignition coil means operatively connected to be switched by said semiconductor means to receive energy from said battery means;

a capacitive tuned series circuit of gas discharge tubes about said semiconductor means between said ignition coil means and said battery means.

4. The circuit of claim 3 and further characterized by said capacitive tuned series circuit of gas discharge tubes including a capacitor across the collector and emitter of a transistor of said semiconductor means and a plurality of similar gas discharge tubes in a series connection across said collector and a base of said transistor, said base being connected to switch means from said battery means.

5. The circuit of claim 3 and further characterized by said capacitive tuned series circuit including a capacitor connected across a collector and an emitter of a transistor of said semiconductor means controlling charge of said coil means by said battery means.

6. An ignition system for an engine, said system comprising;

an electrical power source;

an ignition coil connected to said source;

a semiconductor switch means between the source and the coil to provide a means to control the connection therebetween;

a source of timing signals connected between said power source and said semiconductor means;

a capacitor means between said source and said coil in parallel with said semiconductor means; and a series of gas discharge tubes beween said source and said coil about said semiconductor means to enable the operation of said coil to enjoy the gain of the semiconductor means in increasing dwell time of said coil.

* * * * *